United States Patent [19]

Perälä

[11] Patent Number: 5,033,107

[45] Date of Patent: Jul. 16, 1991

[54] ELECTRIC SAUNA HEATER

[75] Inventor: Reijo Perälä, Hangonkylä, Finland

[73] Assignee: Oy Helo-Tehtaat - Helo Factories Ltd., Helsinki, Finland

[21] Appl. No.: 446,649

[22] Filed: Dec. 6, 1989

[30] Foreign Application Priority Data

Dec. 8, 1988 [FI] Finland ..... 885697

[51] Int. Cl.[5] ..... F24H 3/00

[52] U.S. Cl. ..... 392/311; 392/313; 392/315; 392/318; 392/342; 219/510

[58] Field of Search ..... 219/364, 365, 366, 363, 219/361, 312, 272, 283, 341, 377, 474, 475, 482, 507, 492, 510; 392/368, 374, 308, 451, 342, 394, 386, 311, 313, 315, 318

[56] References Cited

U.S. PATENT DOCUMENTS

| | | | |
|---|---|---|---|
| 3,964,677 | 6/1976 | Schalow et al. | 219/492 |
| 4,110,600 | 8/1978 | Spotts et al. | 219/364 |
| 4,446,356 | 5/1984 | Rimmi | 392/342 |
| 4,740,673 | 4/1988 | Robinson | 392/308 |
| 4,959,527 | 9/1990 | Kivimaa | 392/342 |

*Primary Examiner*—Bruce A. Reynolds
*Assistant Examiner*—Tu Hoang
*Attorney, Agent, or Firm*—Fish & Richardson

[57] ABSTRACT

This invention relates to an electric sauna heater comprising one or more heating resistors (1, 2) and means (3, 4) such as a time switch (3) for controlling the supply of electric power to the heating resistors, the time switch (3) comprising at least three inputs (A, B, C) the first (A) of which is connected to a first time switch contact 3A), the second (B) to a second time switch contact (3B) and the third (C) to a first terminal in a driving motor (M) for the time switch while a second terminal is connected to a counter contact (b) in the second contact (3B). In the invention, in order that the time switch could therefore be connected to two different operating voltages, a resistor (R) is connected between the third input (C) of the time switch (3) and a counter contact (a) in the first contact (3A).

13 Claims, 1 Drawing Sheet

ELECTRIC SAUNA HEATER

Figure 1:
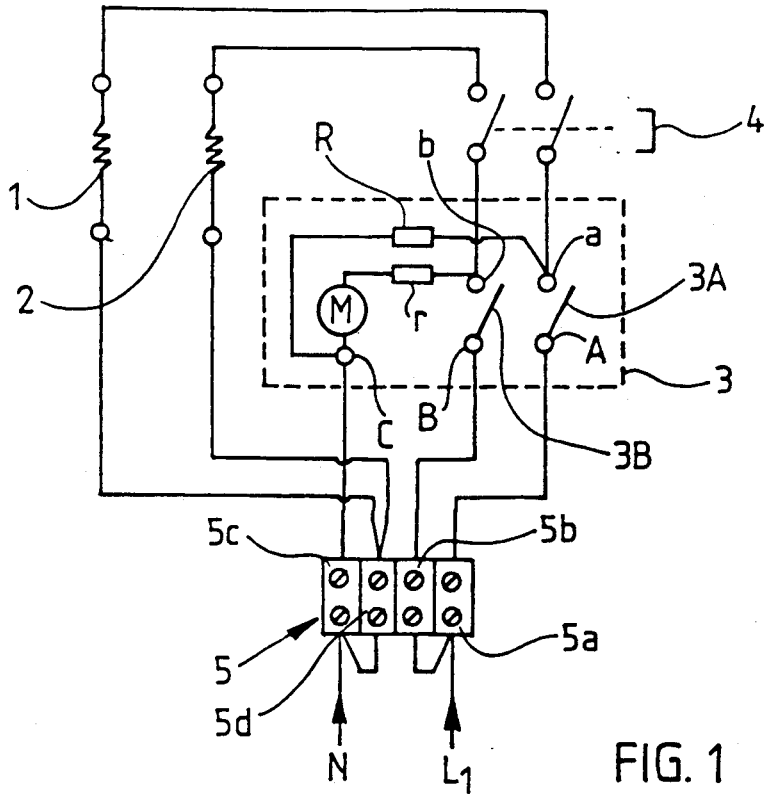

This invention relates to an electric sauna heater comprising one or more heating resistors and means such as a time switch for controlling the supply of electric power to the heating resistors.

According to present requirements in an increasing number of countries, electric sauna heaters must be provided with a time switch for setting a maximum for the uninterrupted switching time of the heater. For example, the maximum switching time in the Nordic Countries is 12 h, in Germany 6 h, and in the United States 1 h. Previously such time switches were mostly spring-operated Thus they were independent of the operating voltage. A drawback, however, was the short operating time, 1 to 6 hours. The operation of time switches with a longer operating time, such as 12 hours, was unreliable. In particular, if a three-phase control is to be obtained with the time switch, the torque is insufficient in a 12-hour clock. In addition to the switching time, most models allow the choice of a pre-selection time. The mechanism of a three-phase clock thereby has to operate six contact points, which requires more power than a spring-operated clock is able to provide. Therefore most time switches are designed to be operated by an electric driving motor. As a consequence, the same time switch cannot be operated at different operating voltages. In Europe, the motor of the time switch is connected to an alternating voltage of 220 V, wherefore a neutral conductor has to be connected to the sauna heater for the motor. Alternatively, it is possible to use a motor designed for an alternating voltage of 380 V. A problem is presented by the Norwegian network, which is 220 V without neutral. On the other hand, voltages used in the United States are 2 or 3·240 V/120 V a.c. or 3·208 V/120 V a.c. The operating voltage of the motor of the time switch is thereby either 120 V a.c. or 240 V a.c. In Japan, in turn, voltage in the low-voltage network is 100 V a.c. between an ultimate conductor and a central conductor and 200 V a.c. between two ultimate conductors. The driving motor of the time switch in smaller and larger sauna heaters uses a voltage of 100 V and 200 V, respectively.

As a result of the great variety of operating voltages, time switches in sauna heaters to be supplied to the different countries have to be provided with driving motors suited for the different voltages. In the worst case, one and the same country may require time switches of different kinds. This increases considerably the need for storing time switches at the manufacturing stage of the sauna heaters; on the other hand, resellers all over the world possibly have to store sauna heaters of different types due to the different operating voltages. In addition, the sauna heaters have to be provided with very clear instructions concerning the operating voltage to be used.

The object of the present invention is to at least partially eliminate the problem caused by the different operating voltages, particularly as far as the time switches are concerned. This is achieved by means of an electric sauna heater according to the invention, which comprises one or more heating resistors; and means such as a time switch with at least a first and a second contact each with a counter contact for controlling the supply of electric power to the heating resistors, said time switch comprising an electric driving motor with a first and a second terminal;

at least a first, a second and a third input, the first input being connected to the first time switch contact, the second input to the second time switch contact and the third to the first driving motor terminal while the second driving motor terminal is connected to the counter contact of the second time switch contact; and a resistor connected between the third time switch input and the counter contact of the first time switch contact to enable the voltage supplied to the driving motor to be connected between either the second and the third time switch input or the first and the second time switch input, depending on the magnitude of the supply voltage.

In the invention, the provision of a resistor between the third input of the time switch and the counter contact of the first time switch contact enables the time switch to be connected selectively to two different operating voltages. This alone decreases considerably the number of required time switches. For example, a single time switch type can be used with each one of the following voltage pairs: 380 V/220 V, 240 V/120 V and 200 V/100 V. The advantage to be obtained by means of the technique according to the invention is of particularly great importance with sauna heaters in which also the resistors may be of the same type irrespective of the operating voltage, their applicability with different operating voltages being effected by connecting the resistors in a determined way with respect to each other. The present invention will be described below with reference to this kind of electric sauna heaters. In the attached drawings, FIGS. 1 and 2 show by way of example a specific embodiment of an electric sauna heater according to the invention when connected to a lower and a higher operating voltage, respectively.

Figure 2:
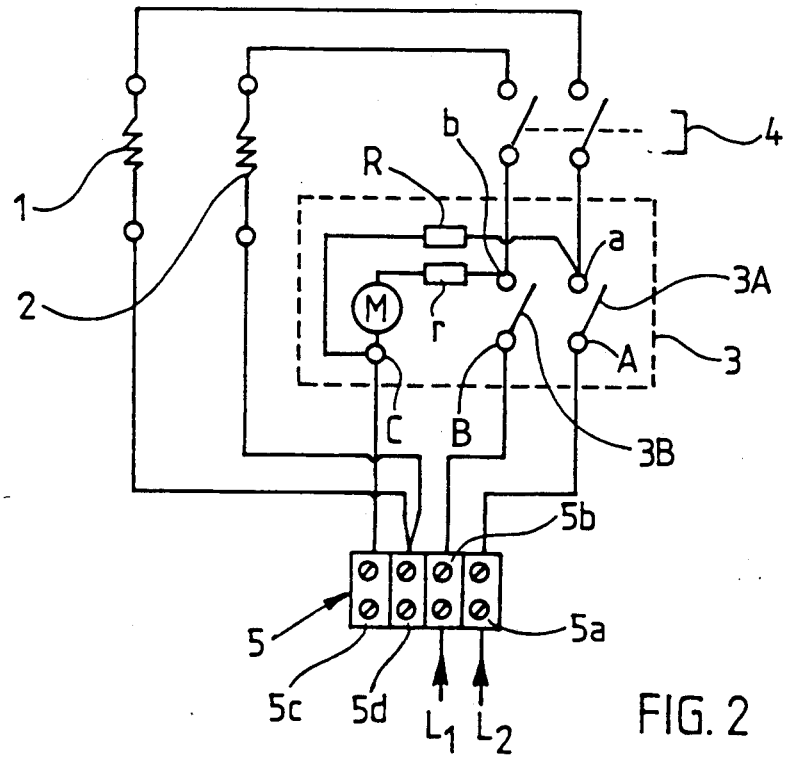

FIGS. 1 and 2 show a general circuit diagram of a relatively low-power electric sauna heater for use in the United States and Japan, for instance. The sauna heater itself comprises two heating resistors 1 and 2 and means for controlling the supply of electric power to the heating resistors 1 and 2, such as a time switch 3 and a thermostat 4. The time switch 3, in turn, comprises three inputs A, B and C. A first time switch contact 3A having a counter contact a is connected to the first input A. A second time switch contact 3B with a counter contact b is connected to the second input B. The third input C is used for supplying operating voltage to a driving motor M for the time switch, one terminal of the driving motor being connected to the counter contact b. In FIGS. 1 and 2, a resistor r is connected in series with the motor M. By means of this resistor r the manufacturer of the driving motor is able to adjust the time switch to different operating voltages. The resistor r is normally positioned within the casing of the driving motor M. According to the invention, a resistor R is connected between the input C and the counter contact a. The inputs A, B and C of the time switch 3 are correspondingly connected to terminals 5*a*, 5*b* and 5*c* in a terminal block 5. One end of each resistor 1 and 2 is connected to the terminal 5*d* of the terminal block 5 while the other end is connected through the contacts of the thermostat 4 to the time switch counter contacts a and b respectively.

When the electric heater is connected to a lower voltage, in the United States to 120 V and in Japan 100

V, for example, the operating voltage is applied to the sauna heater as shown in FIG. 1. Thereby a phase voltage $L_1$ is connected to the terminals 5*a* and 5*b* of the terminal block 5. A neutral conductor N, in turn, is connected to the terminals 5*c* and 5*d*. Thereby the resistors 1 and 2 are connected in parallel between the neutral and phase voltage. The driving motor M of the time switch 3, normally a 2 VA motor, similarly obtains operating voltage from between the neutral N and the phase $L_1$. Thereby the additional resistor R according to the invention is also connected between the neutral N and the phase $L_1$, which, however, is not of any greater importance due to the small size of the resistor. The power loss occurring at the resistor R thereby remains relatively low (about 1–2 W) and is thus negligible.

When the electric heater is connected to a higher voltage, in the United States 240 V or in Japan 200 V, for example, the phase voltages $L_1$ and $L_2$ are connected to the heater as shown in FIG. 2. The phase $L_1$ is thereby connected to the terminal 5*b* of the terminal block 5 and the phase $L_2$ to the terminal 5*a*. The resistors 1 and 2 will thereby be connected in series between the phases $L_1$ and $L_2$. The power of the resistors will thereby be the same as in the connection of FIG. 1, providing that voltage between the phases $L_1$ and $L_2$ is double as compared with the voltage between the neutral N and the phase $L_1$ in the connection of FIG. 1. This is the case in the United States and Japan. In the case of FIG. 2, the motor M of the time switch 3 now obtains operating voltage from between the counter contacts a and b, whereby the additional resistor R according to the invention is connected in series with the motor M. The additional resistor R drops the voltage applied to the motor M to the same level as in the connection of FIG. 1. Thus the resistor R is arranged to effect a voltage loss of 120 V and 100 V in the United States and Japan, respectively.

As appears from the example of FIGS. 1 and 2, one and the same sauna heater can now be connected to a lower and a higher voltage without having to modify the sauna heater itself. The only condition is that the operating voltage is connected to the terminal block 5 in such a manner as required by the operating voltage supplied. Connection to the network is, of course, not carried out until at the installation stage, whereby the resellers need not store sauna heaters of several types, irrespective of the operating voltage.

The electric sauna heaters of FIGS. 1 and 2 above are fully applicable with two different operating voltages. Even in cases where this is not possible to obtain merely by modifying the connection of the resistors, the connection of the invention makes it possible to decrease the number of different time switches required at the assembly stage, thus reducing the need for storing.

The electric sauna heater according to the invention has been described above by way of example by means of one specific connection and it is to be understood that the equipment of the electric sauna heater itself may deviate considerably from the example described without losing the applicability of the time switch with two different voltages.

What is claimed is:

1. An electric sauna heater, comprising:

at least one heating resistor; and means for controlling supply of electric power to the at least one heating resistor, said means comprising:

a time switch comprising:

at least a first and a second contact each with a counter contact;

an electric driving motor with a first and a second terminal;

at least a first, a second and a third voltage input, wherein the first voltage input is connected to the first contact, the second voltage input is connected to the second contact, the third voltage input is connected to the first driving motor terminal, and the second driving motor terminal is coupled to the counter contact of the second contact; and a resistor connected between the third voltage input and the counter contact of the first contact to enable an input voltage supplied to the driving motor to be connected between the first and the second voltage inputs in response to said input voltage being a first voltage magnitude or between the second and the third voltage inputs in response to said input voltage being a second voltage magnitude, said first voltage magnitude being greater than said second voltage magnitude.

2. The electric sauna heater according to claim 1, wherein said first voltage magnitude is approximately double said second voltage magnitude.

3. The electric sauna heater according to claim 1, wherein said first voltage magnitude is approximately 240 volts and said second voltage magnitude is approximately 120 volts.

4. The electric sauna heater according to claim 1, wherein said first voltage magnitude is a single phase voltage, said single phase being connected to both said first and second voltage inputs, said third voltage input being connected to a neutral conductor.

5. The electric sauna heater according to claim 1, wherein said second voltage magnitude has a first and a second phase, said first phase being connected to said first voltage input and said second phase being connected to said second voltage input.

6. The electric sauna heater according to claim 1, wherein said controlling means further comprises a thermostat circuit coupled between said at least one heating resistor and said time switch.

7. An electric sauna heater, comprising:

a voltage input having a first, a second, a third, and a fourth node for accepting an input voltage;

at least a first and a second heating resistor, each having a first end thereof connected to said third node; and a time switch for controlling voltage supplied to said first and second heating resistors, said time switch comprising:

a first and a second contact, each having a respective counter contact, said first contact being connected to said first voltage node and said second contact being connected to said second voltage node, said first counter contact being coupled to a second end of said first heating resistor and said second counter contact being coupled to a second end of said second heating resistor, a motor having a first and a second terminal, said first terminal being connected to said fourth voltage node and said second terminal being coupled to said second counter contact, and a dedicated resistor, independent of said at least first and second heating resistors, connected between said first terminal of said motor and said first counter contact; wherein said dedicated resistor enabling a voltage approximately equivalent to a first voltage to be applied to said motor in response to said input voltage being approximately equivalent to said first voltage or a second voltage, said second voltage being greater than said first voltage, said resistor providing a voltage drop of approximately the difference between said second voltage and said first voltage when said input voltage is approximately equivalent to said second voltage.

8. The electric sauna heater according to claim 7, wherein said second voltage is approximately double said first voltage.

9. The electric sauna heater according to claim 7, wherein said second voltage is 240 volts and said first voltage is 120 volts.

10. The electric sauna heater according to claim 7, wherein said first voltage is a single phase voltage, said single phase being connected to both said first and second nodes, said third and fourth nodes being connected to a neutral conductor.

11. The electric sauna heater according to claim 7, wherein said second voltage has a first and a second phase, said first phase being connected to said first node and said second phase being connected to said second node.

12. The electric sauna heater according to claim 7 further comprising a thermostat circuit coupled between said at least first and second heating resistors and said time switch.

13. The electric sauna heater according to claim 7, wherein said thermostat circuit comprises a first and a second switch, said first switch being connected between said second end of said first heating resistor and said first counter contact, said second switch being connected between said second end of said second heating resistor and said second counter contact.

* * * * *